United States Patent [19]

Lowe et al.

[11] Patent Number: 4,480,396

[45] Date of Patent: Nov. 6, 1984

[54] CRAMPON CONSTRUCTION AND METHOD OF ATTACHMENT

[76] Inventors: Greg E. Lowe, 2560 Buchanan, Ogden, Utah 84401; Michael R. Lowe, Box 361, Homestead House, Eldorado Springs, Colo. 80025

[21] Appl. No.: 89,327

[22] Filed: Oct. 29, 1979

Related U.S. Application Data

[63] Continuation-in-part of Ser. No. 004,635, Jan. 19, 1979, abandoned.

[51] Int. Cl.[3] ..... A43C 15/06; A63B 29/00

[52] U.S. Cl. ..... 36/7.6; 36/124

[58] Field of Search ..... 36/7.6, 62, 64; 12/120.5

[56] References Cited

U.S. PATENT DOCUMENTS

| | | | |
|---|---|---|---|
| 2,525,308 | 10/1950 | McDonnell | 36/7.6 |
| 2,862,310 | 12/1958 | Bodnaruk | 36/7.6 |
| 2,903,726 | 9/1959 | Voster et al. | 12/120.5 |
| 3,786,579 | 1/1974 | Clark et al. | 36/7.6 |
| 3,795,993 | 3/1974 | Simond | 36/7.6 |

FOREIGN PATENT DOCUMENTS

| | | | |
|---|---|---|---|
| 2264044 | 7/1974 | Fed. Rep. of Germany | 36/7.6 |
| 2106932 | 5/1972 | France | 36/7.6 |
| 1355812 | 6/1974 | United Kingdom | 36/7.6 |

*Primary Examiner*—Werner H. Schroeder
*Attorney, Agent, or Firm*—O'Rourke & Harris

[57] ABSTRACT

Crampons formed of straight-sided frame members with at least one such member on each side, but preferably joined together in pairs at each side for lateral and/or longitudinal adjustment to provide for changes in the dimensions of the crampon to suit boots of various sizes, or, if desired, articulation around a horizontal axis, further including integral depending pointed members located and arranged in an aligned configuration for the purpose of piercing snow and ice to provide additional traction for climbers and hikers, and preferably having improved means for quickly and securely fastening the crampon to a boot to stress the sole thereof and thus afford greater rigidity to the crampon.

18 Claims, 7 Drawing Figures

CRAMPON CONSTRUCTION AND METHOD OF ATTACHMENT

RELATED APPLICATION

This application is a continuation-in-part application of copending application Ser. No. 004,635, filed Jan. 19, 1979, now abandoned, and entitled CRAMPON CONSTRUCTION AND METHOD OF ATTACHMENT.

BACKGROUND OF THE INVENTION

The present invention relates generally to crampons employed to provide secure footing for climbers and hikers in snow and ice situations, and more particularly to an improved, simple straight-sided structure including among its features enhanced traction and security, particularly in a traversing mode, easy attachment and disengagement, and having optional adjustability for length and/or width through a wide range.

DESCRIPTION OF THE PRIOR ART

The concept of adding structures to a boot or shoe which provide a number of sharpened metal points for the purpose of piercing the surface of ice or snow thereby increasing traction has been known and studied for some time. The detachable apparatus known as the crampon has, in one form or another, become an indispensible part of the alpinist's and winter hiker's equipment, allowing him rapid conversion of rubber or composition soled boots to footwear suitable for use on areas of ice or packed snow.

A particularly useful arrangement is described in U.S. Pat. No. 3,229,389, issued on Jan. 18, 1966, to George Adams. In this arrangement, separate heel and sole plates, each equipped with descending triangular points of varying length and orientation, are joined together by a flexible strap, the entire apparatus then being attached to the boot by means of additional straps, one encircling the ankle portion of the boot, the other encircling the toe. The configuration taught by Adams, while indeed providing increased traction on ice and snow and allowing reasonable lengthwise adjustability, makes no provision for width adjustment and, in severe weather conditions, might be found to be difficult to quickly attach or detach.

Certain of the problems seen in the Adams arrangement are subsequently addressed and resolved in U.S. Pat. No. 3,685,173, issued on Aug. 22, 1972, to Aldo Piazza. The crampon suggested by Piazza is similar to the Adams construction in that it is comprised of independent sole and heel portions, connected together by a notched rod which provides lengthwise adjustability and a measure of flexibility as a result of articulation between the main members of the assembly. A notable improvement in the Piazza configuration as compared to the Adams design is the use of L-shaped clips adjustably attached to the front portion of the sole plate and positionable to engage the top front portion of the boot sole. A horizontally acting locking lever at the rear of the apparatus engages the rear of the sole, securing the crampon in place, obviating the need for straps and making the crampon easier to use in adverse conditions. The Piazza construction also provides, by means of pivoting frame members, width adjustment of the sole portion of the crampon.

Both the crampon configurations mentioned above are of the hinged type; that is, the sole and heel portions of the apparatus are flexibly connected together across the arch so that they may follow closely the relative movement of the boot sole in a normal walking situation. At times when maximum traction and security are required, many alpinists and hikers prefer a rigid crampon structure. The rigid construction guarantees that a maximum number of ice-gripping points will be in contact with the slippery surface and, therefore, the tractional considerations of the rigid design often outweigh the loss of normal flexibility in the boot sole. U.S. Pat. No. 3,786,579, issued on Jan. 22, 1974, to James Clark, refers to a rigid crampon providing for both width and length adjustment through pivoting frame members. In the Clark apparatus, as in earlier designs cited, the crampon frame supporting the traction points is shaped to roughly conform to the boot sole outline, the reason given being the desirability of having the points as close as possible to the edge of the boot to make the traversing of very narrow ledges safer. While it may indeed be true that locating points or spikes near the edge of the boot sole at its widest point adds to the usefulness of the apparatus in certain narrow ledge situations, the arrangement has drawbacks in other frequently encountered climbing situations. In cross-slope traversing, the points or spikes of a boot perimeter-shaped crampon will contact and fully pierce the snow or ice surface only in the area of the widest part of the boot sole, thereby providing less than optimum traction.

In summary, while existing crampons represent well-received and useful constructions relative to the art of crampon constructions, certain drawbacks and disadvantages do exist.

SUMMARY OF THE INVENTION

The present invention, which provides a heretofore unavailable improvement over previous crampon constructions, comprises a crampon in which ice-piercing metal points are integral with a rigid, straight-sided frame which may be fully adjustable in width and length and provided with secure and easily operated means for attachment to and release from a boot or shoe. In a particularly desirable embodiment, variously shaped points and blades are positioned and oriented so as to provide considerably increased traction in a majority of climbing and hiking situations. If desired, the frame may be articulated for easier walking.

Accordingly, an object of the present invention is to provide a new and improved configuration and method of attachment for a crampon.

Another object of the present invention is to provide a new and improved crampon structure for enhancing traction on ice and packed snow by means of a plurality of metal points arranged in a straight line on a rigid framework along each side of a boot sole.

Yet another object of the present invention is to provide a new and improved crampon structure which may be easily adjusted in length and/or in width to conform to boots of various sizes while maintaining points in a configuration ensuring enhanced traction through various climbing, descending, and traversing situations.

Still another object of the present invention is to provide a new and improved method for attaching a rigid crampon to a boot such that the crampon may be readily attached under adverse conditions and remain securely attached until deliberately released by the wearer.

Yet still another object of the present invention is to provide a new and improved crampon which stresses the boot sole when attached thereto in order to lend strength to the crampon assembly.

Still yet another object of the invention is to provide enhanced traction on rounded ice forms by means of intermediate short points staggered between the large traction points.

Yet another object of the invention is to reduce the sticking of wet snow to the crampon bottom between steps by utilizing a resilient member to eject the snow from the crampon bottom between steps.

These and other objects and features of the present invention will become apparent from the following description.

DETAILED DESCRIPTION OF THE INVENTION

Figure 1:
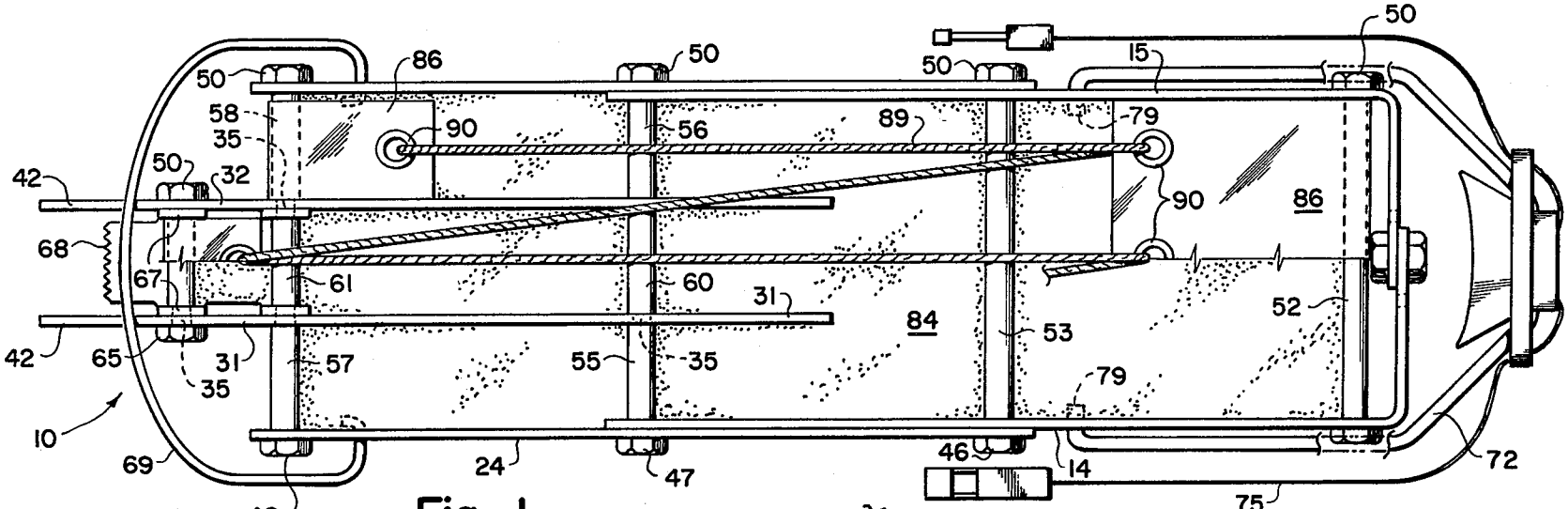
FIG. 1 is a top plan view of a crampon in accord with the instant invention with pad and cover partially removed for clarity.

Referring now to the drawings, wherein like components are designated by like reference numerals throughout the various figures, a crampon is illustrated in FIG. 1 and generally designated by reference numeral 10. Crampon 10 is primarily formed of a hard, high strength material such as steel or an alloy with similar properties.

Figure 2:
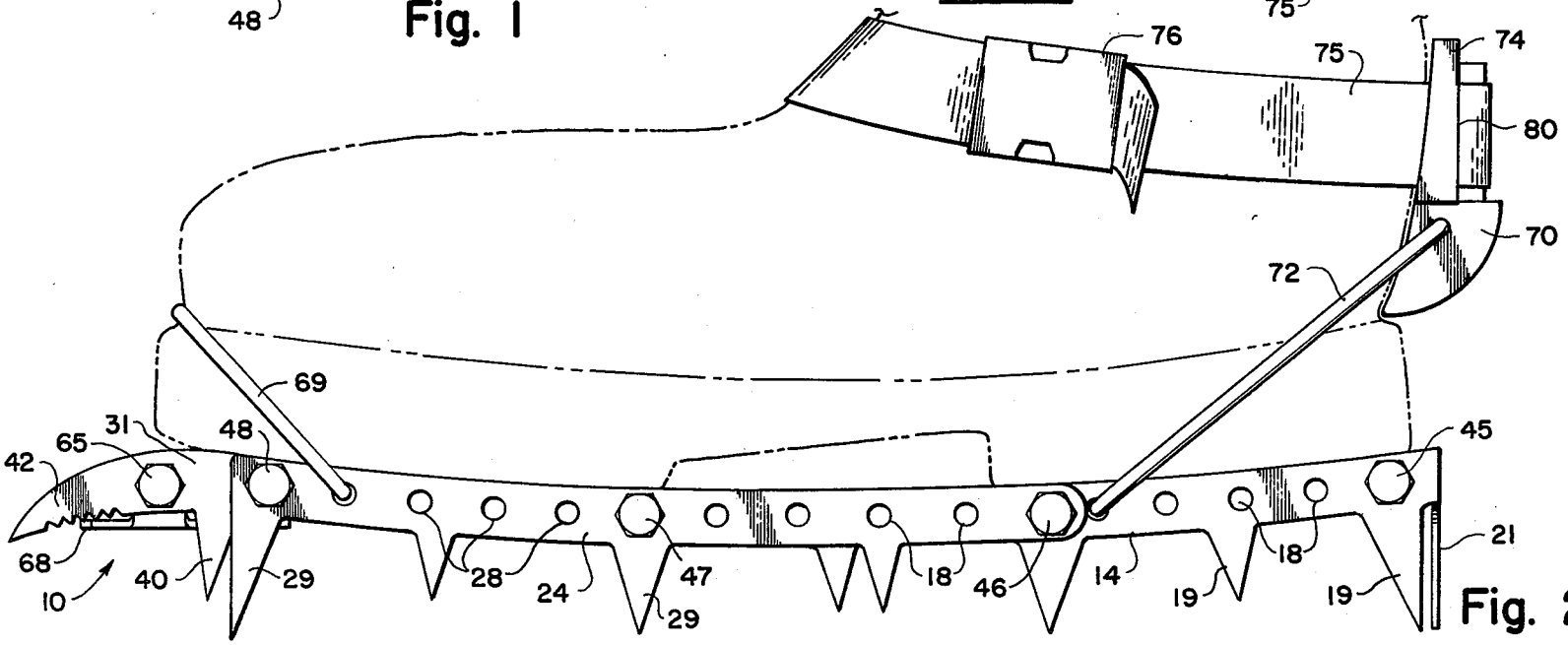
FIG. 2 is a side view of a crampon in accord with the instant invention illustrated as being attached to a boot shown in ghosted fashion.

As illustrated in FIG. 1, crampon 10 is comprised of rear straight-sided frame members 14 and 15, one a mirror image of the other and both pierced along their full length by a plurality of holes 18 shown in FIG. 2. Integral with and extending downward from frame members 14 and 15 are a plurality of triangular points 19 and 21, in the preferred embodiment of two different lengths and alternately disposed, as shown in FIG. 2. The shorter of points 19 and 21 permit purchase on, for instance, substantially horizontal, rounded ice forms which would fit between the longer of points 19 and 21 and thus be guided to the shorter of such points 19 and 21. The rearmost portions of members 14 and 15 are bent inward at an angle of approximately 90°, thereby causing rear points 21 to be oriented with their flat sides perpendicular to the main length of members 14 and 15 and thereby perpendicular to the longitudinal axis of both crampon and boot.

Forward, straight-sided frame members 24 and 25, shown in FIGS. 1 and 2 are similar in material and form to members 14 and 15, are pierced by numerous holes 28, alike in size and spacing to holes 18 in members 14 and 15, and carry depending triangular points 29 in all respects similar to points 19.

In the preferred embodiment, rear frame members 14 and 15 and forward frame members 24 and 25 are formed so as to display a slight curve upward from the center of crampon 10 to the ends in order to more closely conform to the normal curve of a boot sole and to allow a comfortable walking motion. The straight-sided shape of frame members 14, 15, 24 and 25 provide substantial beam strength when composed to more conventional curved sided crampons.

Front tip members 31 and 32, again fashioned from steel or similar high strength material, are pierced by holes 35, of diameters and spacing similar to holes 28 in forward frame members 24 and 25, are shown in FIGS. 1 and 2. Members 31 and 32 have integral triangular points 40 extending downward and terminate, at their forward ends, in downwardly curving and preferably saw-tooth shaped front points 42, as best illustrated in FIG. 2.

Rear frame members 14 and 15, forward frame members 24 and 25, and front tip members 31 and 32 are adjustably joined together to form crampon 10 by bolts 45, 46, 47 and 48, and nuts 50, as shown in FIG. 1. Full spacers 42 and 53, side spacers 55, 56, 57 and 58 and the center spacers 60 and 61, are hollow through the longitudinal axes to accept bolts 45, 46, 47 and 48. By selecting spacers of various lengths the overall width of crampon 10 may be conveniently and securely adjusted. Bolt 45 passes through the rearmost hole 18 in rear frame member 14, then through spacer 52, and ultimately through rear hole 18 in frame member 15, to be secured by nut 50. Similarly, bolt 46 passes through hole 28 in forward frame member 24, hole 18 in frame member 14, thence through aligned holes 18 and 28 in, respectively, rear member 15 and forward member 25 to be ultimately secured by nut 50.

Bolt 47 passes initially through a hole 28 in forward frame member 24, thence through an aligned hole 18 in rear frame member 14, then through side spacer 55, then through a hole 35 in front tip member 31, then through center spacer 60, then through a hole 35 in front tip member 32, then through side spacer 56, then through a hole 18 in rear frame member 15, then through a hole 28 in forward frame member 25 to be finally secured by nut 50. Bolt 48 similarly passes, in order, through a hole 28 in forward frame member 24, side spacer 57, a hole 35 in tip member 31, center spacer 61, a hole 35 in tip member 32, side spacer 58, and a hole 28 in forward frame member 25 to be secured by nut 50 as shown in FIG. 1.

It can be easily seen that adjustment to the width of crampon 10 through a wide range may be effected by substituting spacers of varying lengths for spacers 52, 53, 55, 56, 57, 58, 60 and 61. Likewise, the overall length of crampon 10 may be easily changed to conform to different boot sizes by selecting appropriate holes 18 in frame members 14 and 15 and holes 28 in frame members 24 and 25 for insertion of bolts 46 and 47.

Front tip members 31 and 32 are additionally joined together by bolt 65 passing through the forward most hole 35 in member 31, thence through front spacer 67, thence through forward hole 35 in member 32 to be secured by a nut 50. A snow blade 68 is held in place by bolts 65 and 48 in a horizontal position directly between front points 42 of tip members 31 and 32. Snow blade 68 is useful in snow or soft ice having insufficient strength to afford support by means of points 42 alone.

Holes 28 in forward frame members 24 and 25 serve an additional purpose as anchor points for front wire bail 69, shaped with hooks at either end to pass through and securely engage member 24 and 25. Front wire bail 69 is formed so as to contact the front top portion of a boot sole and hold the forward portion of crampon 10 firmly in place.

Holes 18 in rear frame members 14 and 15 also have the additional purpose, when unoccupied by cross bolts 45 and 46, of serving as securing points for heel binding assembly 70, comprised of wire bail 72, locking lever 72, binding strap 75 and buckle 76. Suitably formed ends 79 of bail 72 pass through and hook to holes 18 in members 14 and 15, thereby positioning binding assembly 70 properly with respect to the heel portion of the boot to which crampon 10 is attached, as shown in FIG. 2. Locking lever 74, pivotally mounted on the straight center section of bail 72 and, in the preferred embodiment, molded of high strength plastic in a form such that the lower end of lever 74 engages firmly the upper surface of the rear sole of a boot and, as the upper end of lever 74 is brought forward, applies tension to the connection between crampon 10 and the boot and locks into position by reason of an over-center action. Binding strap 75, fixed to locking lever 74 passes through suitably formed slots 80 in lever 74. Binding strap 75 is adapted to fit around the ankle portion of the boot and is adjustably secured by buckle 76, preferably molded of plastic in male and female quickly releasable sections.

Bail 69 and heel binding assembly 70, when in place, are in tension and serve to hold the boot sole and crampon 10 in firm engagement thus causing one to lend strength to the other. The boot sole is stressed with crampon 10 and one will not bend substantially without the other. Accordingly, as a result of the attachment means, crampon 10 is stronger when fitted to a boot than when standing alone. Of course conventional bindings could also be employed with crampon 10.

In the preferred embodiment of crampon 10, the internal spaces of the crampon frame, laterally between members 14 and 15 and 24 and 25 and longitudinally from bolt 45 to bolt 49, contain a resilient pad 84 formed of a suitable foam material and covered and held in place by a flexible fabric such as plastic cut and fashioned into cover 86, as illustrated in FIG. 1 in cutaway illustration. Cover 86 passes between points 29 and 40 on the bottom of crampon 10 and is held in place by cord 89 laced through grommeted holes 90 in each free end of cover 86, as seen in FIG. 1. Pad 84 serves to keep the area between points 29 and 40, on the underside of crampon 10, free of ice and packed snow by alternately compressing and expanding in the normal course of walking. When pad 84 expands, snow or other such material is urged away from crampon 10. A spring metal insert (not shown) could also be used. Cover 86 is preferably of a somewhat hydrophobic material, such as most polymers to prevent ice and snow from sticking.

Figure 3:
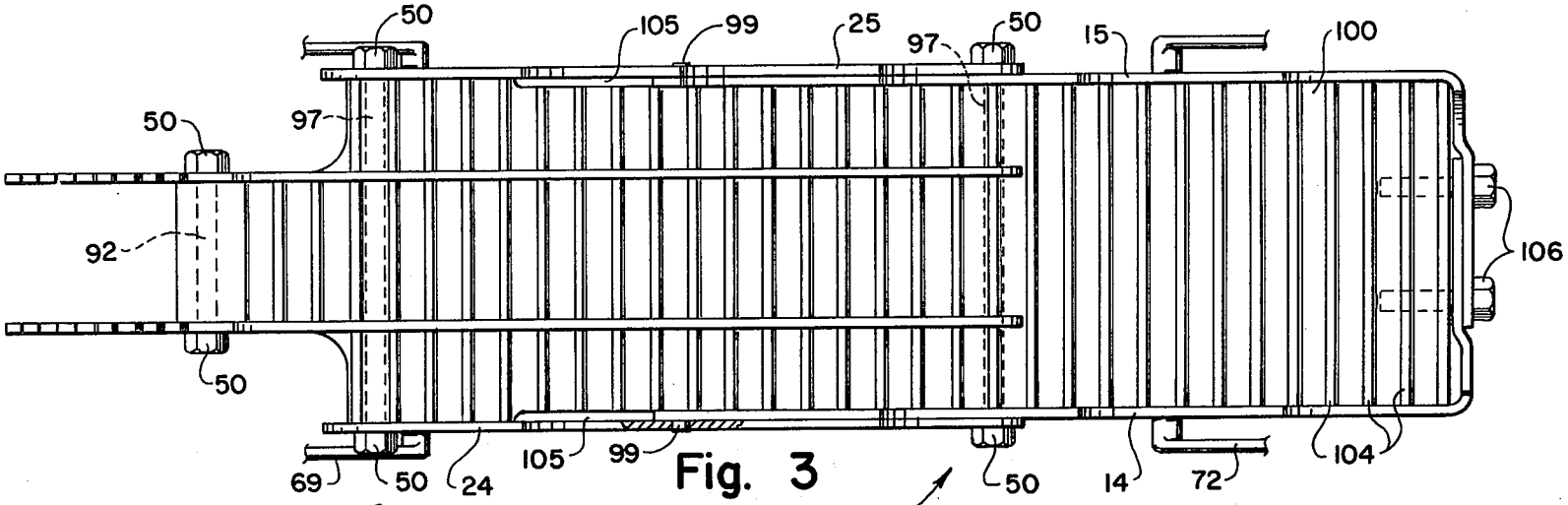
FIG. 3 is a bottom plan view of a crampon in accord with the instant invention including a unitary spacer.

Various other embodiments of the basic crampon of the instant invention, i.e. with a unitary spacer, in a nonadjustable side frame form or in an articulated version, are also contemplated. For instance, with reference to FIG. 3, it will be noted that basic crampon 10 includes short stud 92, and longer studs 97 which extend through frame members 14, 15, 24 and 25, and are employed with nuts 50. Pins 99, which engage frame members 14 and 24 and project from frame members 15 and 25, serve, in conjunction with rear stud 97 to rigidly align frame members 14 and 24, and 15 and 25. Nuts 50 are threaded onto studs 97 to generate a compressive force upon unitary spacer 100. Spacer 100, which is preferably molded of plastic, and most preferably of an oleophillic plastic such as polypropylene, includes lugs 104 defined thereon and defined spaces 105 positioned to permit adjustment in length of side units formed of frame members 14 and 24, and 15 and 25. When adjusting crampon 10, pins 99 are merely reinserted in other adjoining holes defined in frame members 24 and 25 to provide the appropriate alignment and length, and another pair of aligned holes receive rear stud 97. Width can be adjusted either by trimming spacer 100, or by selecting another spacer 100 originally manufactured in a different width. In function, spacer 100 is essentially identical to the plurality of spacers in FIG. 1, but is lightweight, more easily assembled and is intrinsically repellent to snow. Further, lugs 104 provide additional traction.

Figure 4:
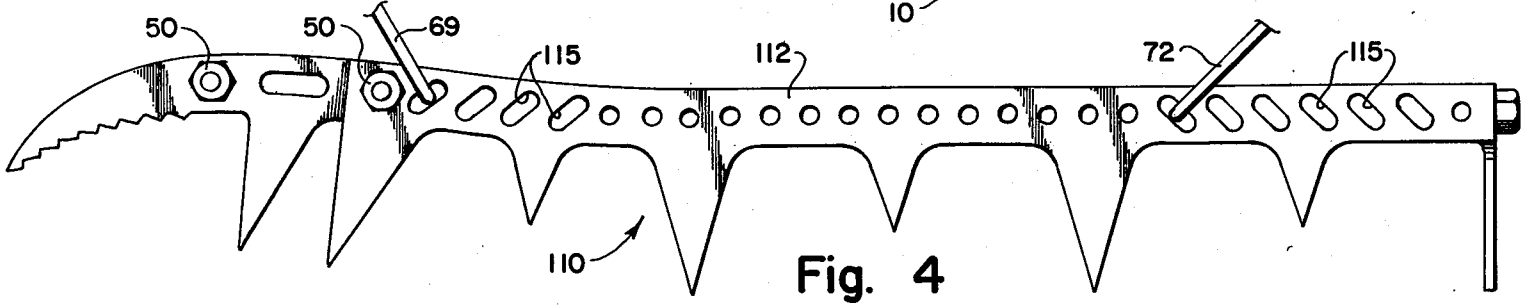
FIG. 4 is a side view of a crampon in accord with the instant invention including a single piece side frame and adjustable attachment means.
Figure 6:
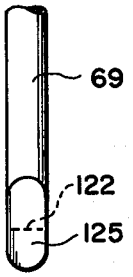
FIG. 6 is an orthogonal view of the bail of FIG. 5.
Figure 5:
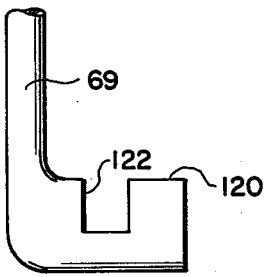
FIG. 5 is a detailed illustration of the bail of FIG. 4.

As shown in FIG. 4, crampon 110 may be formed of a unitary single side frame 112, which is not adjustable in length. A plurality of elongated openings 115 are provided adjacent either end of side frame 112 to afford effective adjustment by repositioning front bail 69 or rear bail 72. Preferably, bail 69, as illustrated in FIGS. 5 and 6, includes an elongated projecting portion 120, having a notch 122 defined therein. End surface 125 of bail 69 is of a cross-sectional configuration complementary to that of opening 115 and thus, when bail 69 is aligned with opening 115, readily passes therethrough. However, as bail 69 is rotated, the walls of notch 122 engage side frame 112 at the narrow axis of opening 115. Thus, bail 69, and in a similar fashion, bail 72, may be readily removed from one opening 115 defined in side frame 112, inserted in yet another opening 115, and secured therein by merely rotating bail 69. In this manner, a single, straight-sided frame member 112, which may be utilized with a unitary spacer 100 as in FIG. 3, or the plurality of spacers such as shown in FIG. 1, or any combination thereof, may be employed while maintaining substantial adjustability for different boot size.

Figure 7:
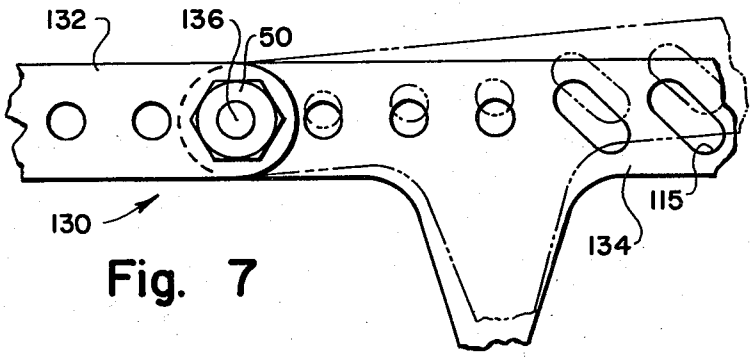
FIG. 7 is a detailed view of the articulated portion of a crampon side frame in accord with the instant invention.

If desired, articulated crampon 130, illustrated in FIG. 7, may be employed. As shown, forward frame member 132 and rear frame member 134 is articulated at, for instance, stud 136 secured by nut 50. Stud 136 is positioned substantially at the location of rearward stud 97 of crampon 10 shown in FIG. 3, thus provide for articulation of crampon 130 to accomodate the bending of the wearers boot sole. Such articulation is desirable for walking on relatively flat surfaces such as glaciers, where traction is more readily gained. The advantages of a straight-sided crampon are maintained in articulated crampon 130.

In summary, the crampon of the instant invention provides, as a result of the simplicity inherent in its rigid, straight-sided configuration, an easily adjustable and easily attachable device for materially increasing the traction available to hikers and climbers in ice and snow conditions. The side member or members, with triangular points arranged in a straight-line configuration, are at once well suited to their purpose and simply manufactured in a single-step stamping or cutting operation. Tension applied to both boot sole and crampon frame when the front bail and locking lever are in place and actuated assures firm and secure attachment of the apparatus, and the ankle strap provides additional security while in no way affecting rapid and simple attachment and release of the crampon. The straight-sided configuration, in addition to simplicity of adjustment in actual or effective length and/or width, also facilitates use of the crampon on either a left or right boot. Location, orientation, and length of the various points provide a climber with superior traction in either ice or snow in situations calling for traversing, scaling of steep faces, and descent of steep slopes. The points arranged in a substantially linear arrangement permits the wearer to traverse steep slopes by engaging substantially all of the points at the crampon edge in the supporting surface. However, more conventional crampons shaped to follow the outline of a boot, engage the surface with only the outermost points. If desired the crampon may be transversely articulated to the boot sole for walking ease.

Although only limited embodiments of the present invention have been illustrated and described, it is anticipated that various changes and modifications will be apparent to those skilled in the art, and that such changes may be made without departing from the scope of the invention as defined by the following claims.

What is claimed is:

1. A crampon comprising:

a pair of elongated substantially linear side units each formed of at least one beam member having a linear row of pointed projections extending therefrom in a common direction and positioned along a substantially straight line, and a plurality of holes defined therethrough in a direction perpendicular to the direction in which the pointed projections extend;

a unitary spacer member positioned between and substantially filling the volume between the side units to position the side units and rows of pointed projections thereon in a substantially parallel relationship; and fastener means extending through aligned holes in the beam members comprising opposite side units and securing the side units and interposed spacer member together;

whereby the crampon will afford improved traction as a result of the aligned pointed projections.

2. A crampon as set forth in claim 1 in which each side unit comprises at least two beam members with at least one of the fastener means extending through aligned holes in overlapping beam members comprising a side unit.

3. A crampon as set forth in claim 2 in which adjacent beam members comprising a side unit are pivotally secured through aligned holes in such beam members to form an articulated crampon.

4. A crampon as set forth in claim 1 in which the unitary spacer member is formed of an oleophillic polymer and includes a plurality of lugs defined on a side thereof adjacent the pointed projections and extending between the side units.

5. A crampon as set forth in claim 1 in which at least one elongated toe member having a pointed end portion is positioned between the side units and engaged by the fastener means and spacer means to be secured thereat, the toe member being oriented with the pointed portion thereof extending beyond the ends of the side units.

6. A crampon as set forth in claim 5 in which a pair of toe members are symmetrically positioned between the side units.

7. A crampon as set forth in claim 6 in which a snow blade is secured in a position substantially parallel to the plane of the fastener means and between the two toe members adjacent the pointed ends thereof.

8. A crampon as set forth in claim 1 in which the side units are slightly curved to define a concave surface at the side thereof opposite the side from which the pointed projections extend.

9. A crampon as set forth in claim 1 in which a bail member adapted to engage the toe portion of the sole of a boot is pivotally attached to the crampon adjacent one end thereof, and a second bail member including means to induce a tension therein is pivotally attached to the crampon adjacent the other end thereof and adapted to engage the heel portion of a boot, whereby the side units and boot may be secured together to form a structural unit.

10. A crampon as set forth in claim 9 in which at least one of the bail members is pivotally attached to the side units at elongated openings having major and minor axes, defined in the side units by projecting portions at the ends of the bail and having a cross-section complementary to the elongated openings, the bail ends having at least one notch defined therein to reduce the major axis of the projection to a dimension less than the minor axis thereof at the location of the notch.

11. An adjustable crampon as set forth in claim 1 in which the pointed projections are arranged in linear rows extending from the elongated side units with the pointed projections at least in part being of alternating longer and shorter configurations.

12. An adjustable crampon comprising:

a pair of elongated side units each formed of at least two beam members having linear rows of pointed projections extending therefrom in a common direction and a plurality of holes defined therethrough in a direction perpendicular to the direction in which the pointed projections extend;

a pair of elongated toe members positioned between the side unit and having holes defined therethrough;

spacer means positioned between the side units and between the side units and toe members to position the side units and toe members in spaced, substantially mutually parallel relationships;

fastener means extending through the holes in the side units and toe members and through the centers of the tubular spacermembers; and means adapted to secure the crampon to a boot.

13. A crampon as set forth in claim 12 in which the side units include at an end of each a portion extending in a direction parallel to the axis of the holes through the side units, and in which such extending portions are joined together.

14. A crampon as set forth in claim 12 in which the spacer means comprise a unitary spacer of polymeric oleophillic material.

15. A crampon as set forth in claim 12 in which each side unit is articulated at the position at which the beam members forming a side unit are secured together.

16. In a crampon comprising a support frame adapted to be secured to a wearer's boot, and a plurality of pointed projections depending from the support frame, the improvement comprising a flexible member disposed between the depending pointed projections and adjacent the support frame, whereby the flexible member may be compressed when the crampon is supporting a weight and may be expanded to expel snow and ice when the weight is released from the crampon.

17. A crampon comprising:

a pair of elongated substantially linear side units each formed of at least one beam member having a linear row of pointed projections extending therefrom in a common direction and positioned along a substantially straight line, and a plurality of holes defined therethrough in a direction perpendicular to the direction in which the pointed projections extend;

spacer means positioned between the side units to position the side units and rows of pointed projections thereon in a substantially parallel relationship;

fastener means extending through aligned holes in the beam members comprising opposite side units and securing the side units and interposed spacer means together; and resilient member secured between the elongated side units and extending substantially therebetween;

whereby the resilient insert will be compressed when the crampon bears weight and will expand upon lifting the crampon to expell snow or ice which may adhere between the side units.

18. An adjustable crampon as set forth in claim 17 in which the resilient insert is a resilient polymeric foam pad and is covered by a pliable oleophillic sheet.

* * * * *